US005675880A

United States Patent [19]

Saikin

[11] Patent Number: 5,675,880

[45] Date of Patent: Oct. 14, 1997

[54] DESCALING SYSTEM FOR USE IN THE MANUFACTURE OF STEEL AND CORRESPONDING METHOD

[75] Inventor: Joel L. Saikin, Chesterton, Ind.

[73] Assignee: Bethlehem Steel Corporation, Bethlehem, Pa.

[21] Appl. No.: 697,763

[22] Filed: Aug. 29, 1996

[51] Int. Cl.[6] ..... B21B 45/04; B08B 9/00

[52] U.S. Cl. ..... 29/81.08; 134/22.12; 137/565

[58] Field of Search ..... 29/81.06, 81.08; 134/22.12, 22.18, 18; 137/563, 565; 210/741, 805, 808; 417/307

[56] References Cited

U.S. PATENT DOCUMENTS

| | | | |
|---|---|---|---|
| 3,429,792 | 2/1969 | Fukui et al. . | |
| 3,984,943 | 10/1976 | Keno et al. . | |
| 4,095,611 | 6/1978 | Hetz . | |
| 4,201,650 | 5/1980 | Nagano et al. . | |
| 4,244,388 | 1/1981 | Feiss . | |
| 4,344,308 | 8/1982 | Shimada et al. | 72/39 |
| 4,731,124 | 3/1988 | Bradbury et al. . | |
| 4,779,639 | 10/1988 | Loos et al. . | |
| 4,929,363 | 5/1990 | Barzuza | 210/808 |
| 4,941,502 | 7/1990 | Loos et al. . | |
| 5,036,689 | 8/1991 | Sekiya et al. | 29/81.08 |
| 5,137,061 | 8/1992 | Deininger et al. | 417/307 |
| 5,137,694 | 8/1992 | Copeland et al. | 137/563 |
| 5,156,706 | 10/1992 | Sephton . | |
| 5,172,716 | 12/1992 | Paptzun . | |
| 5,203,367 | 4/1993 | Akai et al. | 137/563 |
| 5,333,638 | 8/1994 | Maxwell . | |
| 5,370,799 | 12/1994 | Oddo et al. | 210/741 |
| 5,502,881 | 4/1996 | Gaydoul | 29/81.08 |
| 5,589,077 | 12/1996 | Matsuda et al. | 210/741 |

FOREIGN PATENT DOCUMENTS

| | | | |
|---|---|---|---|
| 0278907 | 11/1989 | Japan | 29/81.08 |

*Primary Examiner*—S. Thomas Hughes
*Assistant Examiner*—Tisa Stewart

[57] ABSTRACT

This invention relates to a descaling system for use in the manufacture of steel and corresponding method, including a pump recirculation system. The recirculation system is adapted to make high pressure descaling fluid (e.g. water) instantaneously available to the descaling nozzles for spraying, and to maintain a temperature differential between the pump suction and pump discharge less than about 25° F. during both descaling and recirculation.

9 Claims, 4 Drawing Sheets

DESCALING SYSTEM FOR USE IN THE MANUFACTURE OF STEEL AND CORRESPONDING METHOD

FIELD OF THE INVENTION

This invention relates to a descaling system for use in the manufacture of steel. More particularly, this invention relates to a descale pump recirculation system, and corresponding method, for maintaining the temperature differential (ΔT) across the pump (suction vs. discharge) at no more than about 25° F., thereby reducing pump wear and premature maintenance requirements caused by rapid temperature and pressure changes.

BACKGROUND OF THE INVENTION

During the manufacture of rolled steel, the metal is typically heated in a furnace to a predetermined temperature. Thereafter, prior to rolling, oxidation and scale formations develop on surfaces of the steel and must be removed. Thus, we have the need for descaling which is known in the art. In descaling steel, a high pressure liquid, such as water or the like, is typically directed toward the surface of the steel via a plurality of jet nozzles in order to remove the scales and/or oxidation. Multi-stage descale pumps are used in forwarding liquid under pressure to the nozzles from a reservoir. See U.S. Pat. No. 3,984,943 for an exemplary steel descaling system, the disclosure of which is hereby incorporated herein by reference.

Descale pump operations require high energy pumps (e.g. centrifugal pumps) for supplying the descale system with large volumes of liquid such as water (e.g. up to from about 1,500 to 4,000 gallons per minute or GPM) from a reservoir. Typical descale water sources often include sand, rock, sediment, and/or other environmentally present substances.

The high pressure water flow or spray from the descale nozzle(s) is not continuous, but rather is based on need. In other words, the nozzle(s) are frequently turned on and off (i.e. opened and closed). This is known as cycling, although the cycle need not be periodic. Descale pumps continuously run whether the nozzle(s) are opened or closed. During nozzle open conditions, the pump(s) discharges water at a rate of from about 0–4,000 GPM. When the nozzle(s) is closed or barely open, the pump discharges either very little or no water (i.e. shutoff condition), because there is no place for the water to go if no recirculation system is present. Due to their rapid cycling, the discharge (or outlet) of a typical descale pump may experience flow variations which range, often several times within a single minute, for example, from 0 GPM up to about 1,500–4,000 GPM, and then back down to 0 GPM.

In view of the above, it will be appreciated that problems arise during low or no flow pump conditions (i.e. nozzle shutoff) when the pump is running, but not permitted to pump water through the system (i.e. the water just sits in the pump or the flow is severely reduced because no descaling is taking place). Operation of a high energy pump during shutoff conditions for prolonged periods of time causes the pump's input energy (e.g. 1,750 horsepower) to be converted into heat within the pump when the water is not permitted to flow through the pump and remove heat. When heat builds up in the pump, many components experience thermal growth which affects internal pump components and clearances (e.g. in seals, discs, and the like) and may accelerate wear within the pump. This, of course, leads to premature pump failure, or maintenance requirements.

In view of the above, it is apparent that there exists a need in the art for a system and/or method for addressing low or no flow conditions in high energy pumps of the sort used for descaling and other activities, for the purpose of reducing maintenance requirements and prolonging the life of such pumps.

Recirculation systems for pumps are old and well known throughout the art. Unfortunately, currently known recirculation valves have problems of their own, as they are designed for use in the 400–600 GPM range and for positioning in series with the pump and the system being supplied. Many such valves include mechanical linkage components, commanded by a check valve, which would experience an undesirably high failure rate in steel descaling systems due to the rapid cycling, high flow rate requirements, and environmental materials in the water. Additionally, typical recirculation valves would be prone to poor sealability or leakage in descale applications due to the rapid pressure changes in the fluid being pumped, and would experience a high failure rate when exposed to the inherent environmental elements such as sand, rock, and the like (e.g. from the water supply) present in descaling water.

Prior art pump recirculation systems have suffered from the following problems: (i) in the prior art, high liquid pressure is not instantaneously available at nozzles; and/or (ii) the precise temperature differential across the pump discharge and suction (i.e. outlet and inlet) is not taken into consideration thereby often leading to high temperature variations within the pump which leads to premature pump failure, tolerance problems, and increased maintenance requirements.

In view of the above, there exists a need in the art for (i) a recirculation system specifically adapted for use in a descaling system for prolonging valve and pump life while allowing for the instantaneous availability of high pressure liquid for descaling jet nozzle use; (ii) the provision of a predetermined recirculation on-off (i.e. open-closed) valve in a high pressure and rapidly cycling descaling environment able to stand up to both environmental factors (e.g. sand in the water) and stresses inherent in descaling systems; and (iii) a descale system/method for maintaining an acceptable temperature differential (ΔT) between the pump discharge (outlet) and suction (inlet) so as to prolong the life of the pump.

It is a purpose of this invention to fulfill the above-described needs in the art, as well as other needs which will become apparent to the skilled artisan from the following detailed description of this invention.

SUMMARY OF THE INVENTION

Generally speaking, this invention fulfills the above-described needs in the art by providing a method of descaling steel comprising the steps of:

providing steel which is to be descaled and at least one nozzle member adapted to be opened and closed for selectively directing high pressure descaling liquid toward the steel so as to descale same when the nozzle is opened;

providing a descaling liquid supply and a corresponding liquid pump having an inlet and outlet;

continuously operating the pump during both liquid flow and no flow conditions so as to pump the liquid from the supply to the nozzle at a pressure of from about 1,400–2,500 psi during both open flow or flow, and closed-nozzle or no-flow conditions; and recirculating the descaling liquid from the pump outlet to the pump inlet during no-flow or low-flow conditions, such as when the nozzle is closed, so as to continuously maintain the temperature differential (ΔT) between the pump outlet and pump inlet less than or equal to about 25° F.

According to certain preferred embodiments, the method further comprises the steps of detecting and measuring the pressure of the liquid soon after the liquid exits the pump outlet; and opening a recirculation valve when the detected and measured pressure exceeds a predetermined first threshold value thereby allowing the liquid to be recirculated to the supply.

According to still further preferred embodiments, the method includes the step of creating a back pressure on the valve and controlling recirculating fluid flow by providing a plurality of spaced apart restrictive orifices in series with one another through which the recirculating liquid passes downstream of the valve.

This invention further fulfills the above-described needs in the art by providing a recirculation system for a high energy pump which enables liquid at a pressure of from about 1,400–2,500 psi to be instantaneously available to a jet descale nozzle for spraying, the recirculation system comprising:

a pressure detector located proximate a pump discharge for measuring the pressure of the liquid being pumped;

means for opening a recirculation valve when the detector detects a pressure greater than a predetermined threshold; and recirculating means including a plurality of orifices in series with one another for maintaining the pressure of the liquid proximate the pump discharge at from about 1,400–2,500 psi and for maintaining a liquid temperature differential between the pump discharge and pump suction less than or equal to about 25° F. so as to prolong the life of the pump and maintain pump tolerances.

This invention will now be described with respect to certain embodiments thereof, accompanied by certain illustrations.

BRIEF DESCRIPTION OF THE DRAWINGS

FIG. 2(*b*) is an elevational view of an end of the FIG. 2(*a*) restrictive series orifice system;

FIG. 3(*b*) is an elevational view of an end of the FIG. 3(*a*) restrictive series orifice system;

FIG. 4(*b*) is an elevational view of an end of the FIG. 4(*a*) restrictive series orifice system.

DETAILED DESCRIPTION OF CERTAIN EMBODIMENTS OF THIS INVENTION

Figure 1:
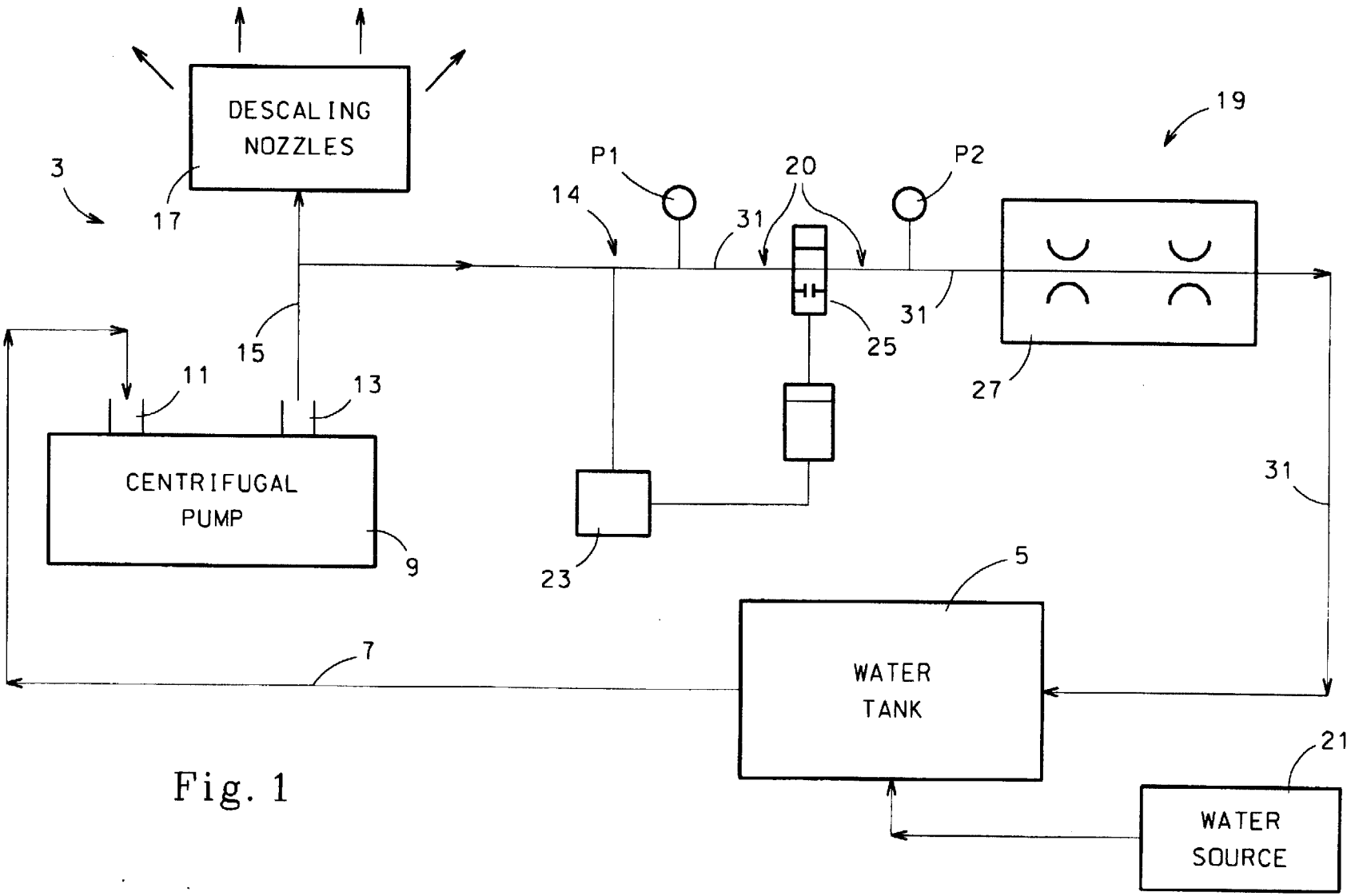
FIG. 1 is a schematic view illustrating a descaling system according to an embodiment of this invention adapted to be used in the manufacture of steel.

In the accompanying drawings like reference numerals indicate like parts throughout the several views.

FIG. 1 is a schematic view illustrating a descaling system 3 to be used in the manufacture of rolled steel according to certain embodiments of this invention. While I prefer that the invention be used in descaling operations at a steel mill, those skilled in the art will recognize that the invention has utility in systems utilizing high energy pumps for supplying high pressure liquids on other than a continuous basis, such as hydro blasting, water heating, and the like. Steel descaling system 3 in FIG. 1 includes liquid tank or reservoir 5, fluid conduit system 7 connecting reservoir 5 to the inlet or suction 11 of descale pump 9, pump outlet or discharge 13, fluid conduit system 15 connecting the discharge 13 of high energy pump 9 (e.g. about 1,750 hp) to both descaling nozzles 17 and recirculation system 19, and a liquid source 21 such as an existing lake or the like for supplying reservoir 5 with a descaling liquid such as water. Pump 9 may be, for example, a 160 inch plate mill descale pump, Worthington 6WC135. Also, while it is intended that there be a plurality of descaling nozzles 17, the actual number will be based upon system requirements.

Recirculation system 19 is connected between pump discharge 13 (by way of conduit system 15) and reservoir 5. Pump recirculation system 19 includes solid state pressure detector and switch 23 for selectively opening and closing recirculation on-off valve 25 as a function of pressure, and a series of restrictive orifices 27 for controlling the water flow through recirculation system 19 and creating a back pressure on valve 25. Valve 25 and orifice system 27 are located in parallel to the conduit system connecting the pump discharge to nozzle(s) 17 so that the orifices can create and maintain a particular back pressure on valve 25. When pressure detector and switch 23 detects a pressure at 14 equal to or greater than a predetermined threshold pressure (e.g. 1,950 psi), switch 23 causes valve 25 to open, thereby enabling water from discharge 13 and conduit system 15 to recirculate back into tank or reservoir 5 while simultaneously maintaining an acceptable temperature differential (ΔT) less than or equal to about 25° across the inlet 11 and outlet 13 of pump 9 and maintaining an acceptable water pressure (e.g. greater than about 1,400 psi) in conduit system 15 adjacent nozzle(s) 17 so that when the nozzle(s) 17 are selectively opened by an operator, water under high pressure (e.g. from about 1,400 to 2,500 psi, preferably from about 1,400–2,000 psi) is immediately available for spraying toward the steel so as to descale same. Thereafter, when detector 23 detects a pressure less than the threshold, for example, it causes valve 25 to close so as to shut down recirculation system 19 and maintain a sufficient water pressure in conduit system 15 for use by jet nozzles 17.

Due to nozzle(s) 17 being opened and closed depending upon need, the fluid flow rates within system 15 may range from about 0 to 1,500 GPM as frequently as several times per minute. At times, however, the fluid flow demand in descaling system 3 is in excess of about 4,000 GPM, with two pumps on line.

The above-discussed temperature and pressure parameters are achieved while utilizing only the minimum required fluid (e.g. water) flow rate through recirculation system 19. In other words, recirculation system 19 causes pump 9 to operate with a minimum flow rate when descale system 3 has little or no demand (i.e. when jet nozzles 17 are at least partially shut down or closed), this minimum flow rate being sufficient to maintain the pump inlet/outlet temperature differential no greater than about 25° F.

While FIG. 1 illustrates only one descale pump 9, additional pumps may be used in a descale system 3. For example, three separate descale pumps, all equipped with recirculation systems 19, may be used in a single steel descaling system 3.

The operation of recirculation system 19 is controlled by using, for example, a solid state pressure switch 23 according to certain embodiments of this invention, such a switch being utilized for controlling the opening and closing of solenoid operated valve 25. The pressure source for detector and switch 23 is in or in communication with discharge line 15 of descale pump 9. The threshold settings of switch 23 may be, for example, about 50–100 psi below the top discharge pressure of pump 9 for opening valve 25, and about 100–150 psi below the "opening threshold" for closing valve 25. For example, when the maximum discharge pressure of pump 9 is 2,000 psi, switch 23 may function to open valve 25 when the switch detects a pressure at 14 in conduit system 15 or 31 of 1,950 psi (i.e. from about 50–100 psi below 2,000 psi). When such a pressure is detected by switch 23, valve 25 is opened and recirculation system 19 goes into operation, allowing water from pump discharge 13 and conduit system 15 to recirculate back to reservoir 5 via conduit system 31. Thereafter, given these parameters, when pressure switch 23 detects a pressure of, for example, 1,800 psi (i.e. from about 100–150 psi below 1,950 psi), switch 23 functions to close valve 25, thereby disabling recirculation system 19 so as to maintain a sufficiently high water pressure (e.g. from about 1,400–2,000 psi) available to nozzle(s) 17.

Figure 5:
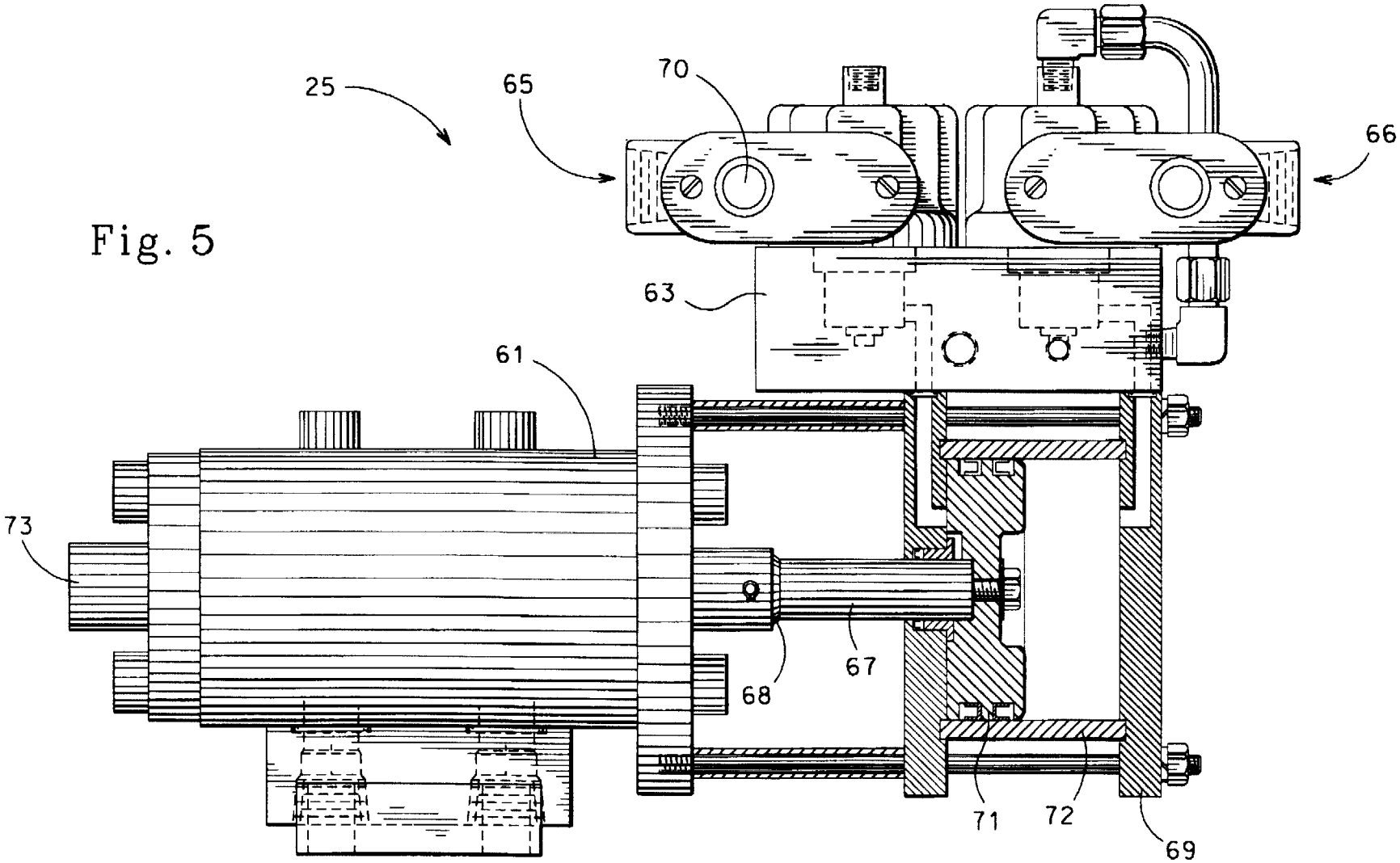
FIG. 5 is a partial cross-sectional view of a preferred on-off valve to be used in the recirculation system of FIG. 1 according to certain embodiments of this invention, this illustrated valve being available from Salem Valve Company as Model No. 106-558-154-303, Salem, Ohio.

According to certain embodiments of this invention, valve 25 is a Salem valve, Part No. 106-558-154-303, which is a two-way, two-position valve, solenoid pilot operated, normally closed, 2,000 psi rated, and air operated (see FIG. 5). Pressure switch 23, according to certain embodiments of this invention, may be a Barksdale solid state pressure switch, Part No. 2AG11T-13C-01-SW, 150/3,000 psi range. Pump 9, according to certain embodiments of this invention, may be a conventional Worthington multistage pump, Model No. 6WC135.

Recirculation system 19 is provided so as to lengthen the life of and stabilize the operation of descale pump 9, and to provide a more economical method of controlling recirculation flow at the lowest possible flow volume. A minimum flow volume required for system 19 to properly function according to certain embodiments is a function of orifice system 27 and may be, for example, about 70–110 GPM. Recirculation system 19 increases the life of pump 9 by maintaining a maximum temperature differential ($\Delta T$) between inlet 11 and outlet 13 of about 25° F. Because of the recirculation system 19, then there is sufficient liquid available at the desired pressure when nozzles 17 are to be operated. This is possible because the pump 9 need not take appreciable time to increase the pressure and/or flow as may be required with a standard recirculation valve. With the conventional recirculation valve, there is a need to build-up pressure, thus complicating descaling operations and/or producing product which is not adequately descaled.

The piping 31 in high pressure areas/high velocity areas of system 19 may be, for example, 1¼ inch Sch. 160, 316 stainless steel, and in low pressure areas (e.g. 7) 1¼ inch Sch. 80 black pipe may be used. 6,000 # pipe fittings may be used in high pressure areas, and 3,000 # fittings in lower pressure areas. Hoses 20 are provided for pulse shock suppression before and after valve 25, such hoses being, for example, 18 inches long O.A., 6,500 psi, hydro blast hoses, with No. 12 JIC swivel nuts on each end.

The provision of restrictive orifice system 27 in recirculation system 19 is another important feature of this invention. Orifice system 27 creates sufficient back pressure on valve 25, so as to keep the fluid velocity within conduit system 31 below a destructible level thereby preventing erosion of valve 25. Orifice system 27 also controls the exit velocity of fluid leaving orifices 27, and the noise generated thereby, through the number of restrictive orifices utilized and the design of same.

Figure 2A:
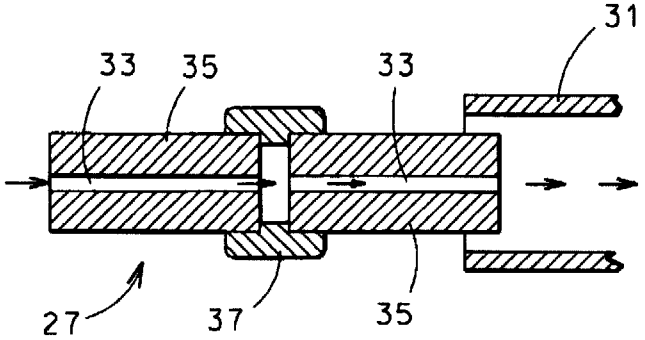
FIG. 2(*a*) is a side cross-sectional view of a restrictive series orifice system used in the recirculation system of FIG. 1 according to certain embodiments of this invention.
Figure 2B:
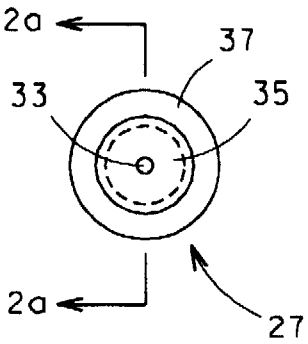

FIGS. 2(*a*) and 2(*b*) illustrates an orifice system 27 for use in system 9 according to a particular embodiment of this invention, FIG. 2(*a*) being a side cross-sectional view and FIG. 2(*b*) an elevational view of this orifice system 27. As illustrated in FIGS. 2(*a*)–2(*b*), two separate annular orifices 33 (or 35) are provided in a spaced series relationship with one another, united by way of annular coupling 37. The length of each orifice 33 (or 35) may be, for example, four inches, with each orifice 33 (or 35) being defined by a 16/64 inch bore 33. According to certain embodiments, the outer diameter of pipe sections 35, which define orifices 33 (or 35), is about 1.660 inches and is made of stainless steel. Coupling member 37 holds orifices 33 (or 35) and thus housing members 35 together. Coupling 37 may be, for example, a 6,000 # 316 SS coupling according to certain embodiments. By providing the series orifice system 27 of FIGS. 2(*a*)–2(*b*) in conduit system 31 of FIG. 1, the back pressure mentioned above is created on valve 25 as the water in the recirculation system is only permitted to flow through elongated orifices 33 (or 35), the diameter of orifices 33 (or 35) being substantially less than that of the piping or hose making up conduit flow system 31. The FIG. 2(*a*)–2(*b*) orifice system as described above is referred to below in Chart 2 as "MK-A".

Figure 3A:
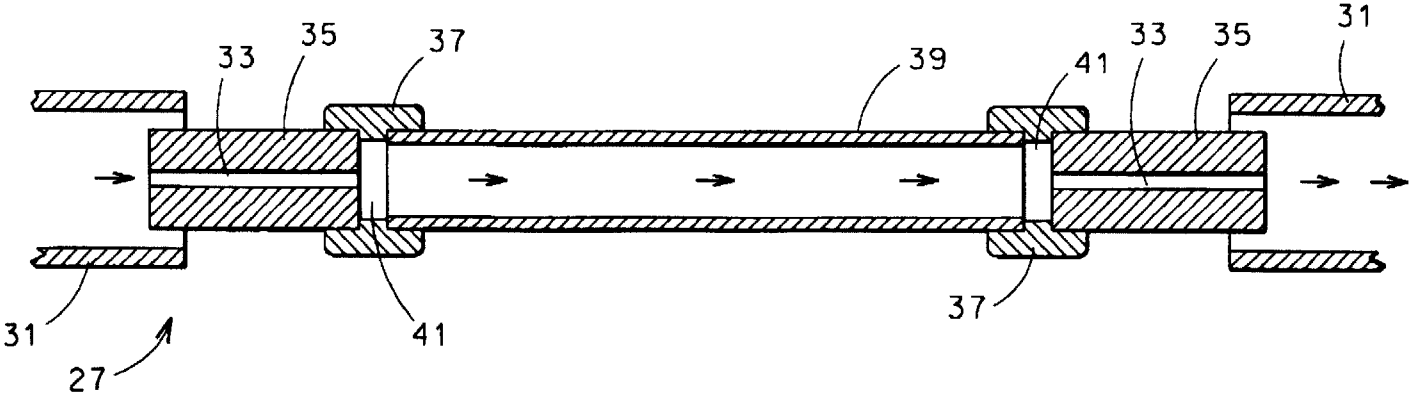
FIG. 3(*a*) is a side cross-sectional view of another restrictive series orifice system which may be used in the recirculation system of FIG. 1 according to other embodiments of this invention.
Figure 3B:
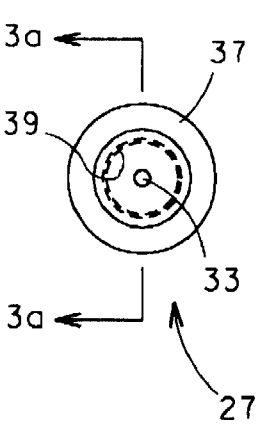

FIGS. 3(*a*)–3(*b*) illustrate another orifice system 27 which may be used in the FIG. 1 recirculation system 19 according to certain embodiments of this invention. Surprisingly, the use of the FIG. 3(*a*)–3(*b*) orifice system 27 results in a higher instantaneous water pressure being available in conduit system 15 for instantaneous use by nozzle(s) 17, than does the FIG. 2(*a*)–2(*b*) orifice system 27. See Chart 2 below. Additionally, the FIG. 3(*a*)–3(*b*) orifice system 27 results in a higher pressure at P2 (i.e. in conduit system 31 between valve 25 and orifice system 27). The use of the FIG. 3(*a*)–3(*b*) orifice system 27 results in a lower flow rate from conduit system 15, 31 through the orifice system 27 and recirculation system 19. As shown in Chart 2 below, the FIG. 3(*a*)–3(*b*) orifice system 27 resulted in this flow rate being from about 89.1–91.5 gallons per minute (GPM), while the FIG. 2(*a*)–2(*b*) orifice system resulted in a flow rate of about 110.81 GPM. The lower the flow rate, the higher the pressure available to nozzle(s) 17.

As shown in FIG. 3(*a*), orifice system 27 includes the exact same orifices 33 (or 35) and annular housing members 35 as the FIG. 2(*a*)–2(*b*) embodiment, and the same type of annular couplings 37. However, in the FIG. 3(*a*)–3(*b*) embodiment, two couplings 37 are provided (instead of one), and an additional section of elongated pipe or conduit 39 is provided between the two couplings 37. The provision of flow conduit 39 between couplings 37 results in a quieter operation of the recirculation system. Also, a lower flow rate and higher available instantaneous pressure results because the flowing descaling liquid is permitted to disperse more fully between orifices 33. The length of pipe section 39 according to certain embodiments of this invention may be about twelve inches, with the inner diameter of conduit 39 being substantially larger than the inner diameter of the annular bores defining orifices 33 (or 35). As shown in FIG. 3(*a*), couplings 37 hold elongated pipe member 39 in position, and spaced from, the respective housing members 35 defining orifices 33 (or 35). Thus, annular cavities 41 are provided between the ends of pipe 39 and the adjacent ends of members 35.

Figure 4B:
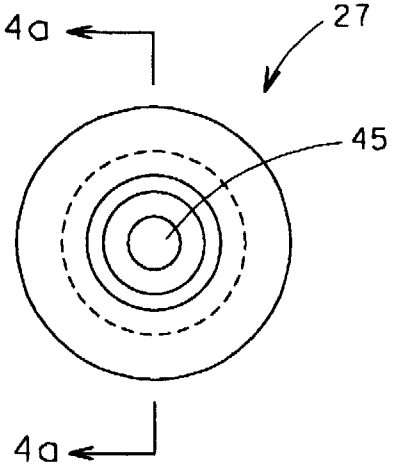
FIG. 4(*a*) is a side cross-sectional view of yet another restrictive series orifice system to be used in the recirculation system of FIG. 1 according to still other embodiments of this invention.
Figure 4A:
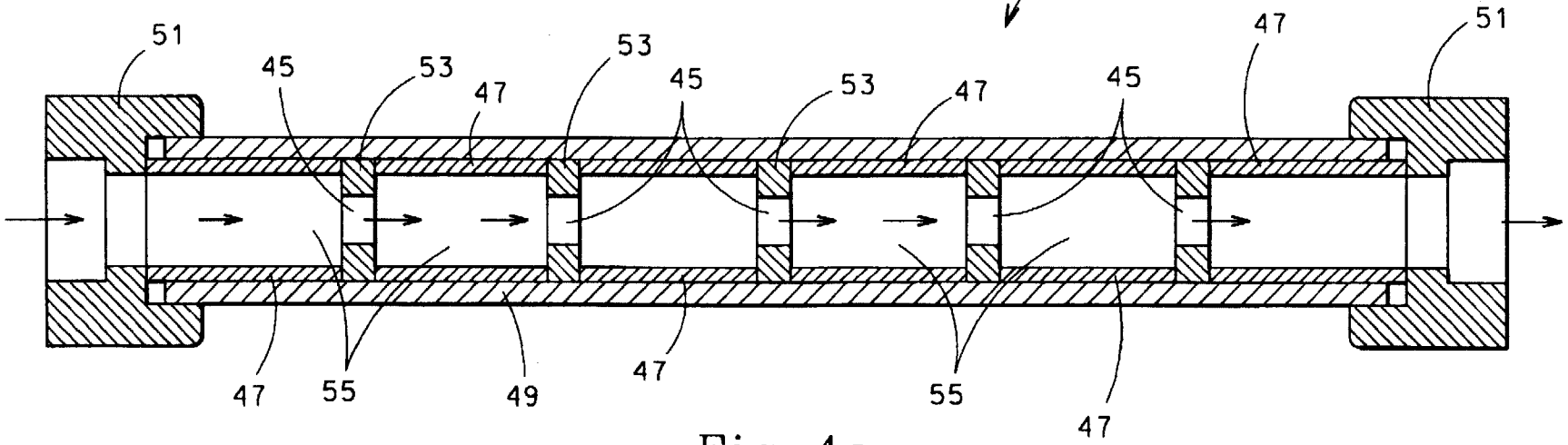

FIGS. 4(*a*)–4(*b*) illustrate yet another orifice system 27 which may be used in the recirculation system 19 of FIG. 1. As in the orifice systems shown in FIGS. 2(*a*)–3(*b*), elongated system 27 of FIGS. 4(*a*)–4(*b*) includes a plurality of annular orifices 45 (or 53) disposed in series, or in a back-to-back relation, with one another. Five such orifices 45 (or 53) are provided in the FIG. 4(*a*)–4(*b*) embodiment. Also provided are annular spacers 47 for maintaining the position of orifices 45 relative to one another within annular pipe or conduit 49. A pair of socket weld couplings 51 are provided at opposite ends of pipe 49. Couplings 51 enable the orifice system 27 to be affixed within fluid conduit system 31. The FIG. 4(*a*)–4(*b*) orifice system is quieter in operation and is designed to result in a lower fluid flow rate and exit velocity than both the FIG. 2 and FIG. 3 embodiments due to the additional orifices 45 (or 53) and cavities 55 therebetween. The two end spacers 47 fit snugly between and contact their adjacent orifice members 53 and couplings 51. The inner diameter or fluid flow area through the FIG. 4 system 27 is substantially the same through couplings 51 and spacers 47, except for the restricted flow areas created by the apertures or orifices 45 (or 53) defined in washer-like members 53.

Still referring to the FIG. 4(*a*)–4(*b*) orifice system 27, the bore or diameter of each orifice 45 may be about 9/16 of an inch while the lateral thickness of each annular washer-like member 53 defining orifices 45 may be about ½ inch according to certain embodiments. As shown in FIG. 4(*a*), the plurality of cavities 55 defined between the respective orifices 45 result in a reduced water flow rate through the orifice system than in the FIGS. 2 and 3 embodiments as the diameter of annular cavities 55 is substantially larger than the diameter of orifices 45 (or 53) thus allowing diffusion or dispersion of the water between orifices.

A typical operation of the FIG. 1–4 descaling system will now be described. Descaling fluid, such as water, is fed from an available water source 21 (e.g. lake) into reservoir 5. From reservoir 5, the water is communicated through fluid conduit system 7 to pump suction or inlet 11. Pump 9 causes the water to be pumped from inlet 11, through the pump, and out of outlet or discharge 13 into conduit system 15. When a user selectively opens at least one of descaling nozzles 17, the pumped water flows through conduit system 15 and is sprayed out of the opened jet nozzle 17 and directed toward the steel, so as to descale same in a conventional manner. When all nozzles 17 are opened, the pressure in conduit system 15 typically results in valve 25 being closed. However, when some of or all of nozzles 17 are closed (i.e. when descaling is partially or fully shut down) the pressure of the water in conduit system 15 begins to rise. When pressure switch 23 detects that the pressure at 14 has reached, for example, a threshold of 1,950 psi, switch 23 causes valve 25 to open, thereby allowing the water to flow from conduit system 15 through recirculation system 19 and back into reservoir 5. When valve 25 is open, the water flows through conduit system 31, through valve 25, through the series arranged orifices 27, and thereafter back into reservoir 5 by way of conduit system 31. The design of recirculation system 19 including orifice system 27, pressure switch 23 and valve 25, results in the temperature differential (ΔT) between pump inlet 11 and outlet 13 being no greater than about 25° F., regardless of whether nozzles 17 are opened or all closed. The pressure at P2 is typically less than the pressure at P1 due to the flow passage in valve 25. However, depending upon the orifice system 27 in use, the instantaneously available pressure in conduit system 15, even when recirculation system 19 is functioning, is greater than about 1,400 psi, and is typically from about 1,400–2,500 psi, preferably from about 1,400–2,000 psi. Thus, if an operator should decide to open a particular nozzle(s) 17 while valve 25 is open, the water pressure adjacent the nozzles is still sufficient enough to allow the sprayed water to descale the steel. When one or a plurality of nozzles 17 are selectively opened by an operator, the pressure in conduit system 15 and at P1 drops. Whenever pressure switch 23 detects a pressure, for example, less than or equal to a lower threshold of about 1,800 psi, it causes valve 25 to close. In such a manner, high liquid pressure is maintained in conduit system 15 and is always available for selective use by nozzles 17. In some situations, valve 25 is caused to cycle open and closed on a regular basis even when no or only a few nozzles 17 are in use in order to maintain such a high water pressure in conduits 15.

This invention will now be described below with respect to certain examples. Chart 1 below contains water temperature data resulting from fifteen different tests that were conducted. Chart 2 below includes pressure data from seven tests.

CHART 1 WATER TEMPERATURE DATA DURING BOTH NOZZLE OPEN AND DELAY (CLOSED) CONDITIONS

| | Test No. | | | | | | | | | |
|---|---|---|---|---|---|---|---|---|---|---|
| | 1 | 2 | 3 | 4 | 5 | 6 | 7 | 8 | 9 | 10 |
| Descale Pumps On Line | 1–3 | 1–3 | 1–3 | 1–3 | 1–3 | 1–3 | 1–3 | 1–3 | 1–2 | 1–2 |
| Descale Pump No. | 1 | 1 | 1 | 1 | 1 | 1 | 1 | 1 | 1 | 1 |
| Recirculation Valve, O/C | O | O | O | O | O | O | O | O | O | O |
| Suction Temperature | 52 | 51 | 53 | 53 | 56 | 55 | 56 | 51 | 54 | 52 |
| Discharge Temperature (F.) | 75 | 75 | 75 | 75 | 71 | 75 | 70 | 67 | 59 | 70 |
| Differential Temperature (ΔT) | 23 | 24 | 22 | 22 | 15 | 20 | 14 | 16 | 5 | 18 |
| I.B. Seal Water Temperature | 55 | 56 | 55 | 55 | 55 | 55 | 57 | 56 | 53 | 54 |
| O.B. Seal Water Temperature | 80 | 83 | 80 | 82 | 80 | 82 | 76 | 72 | 70 | 69 |
| Descale Pump No. | 3 | 3 | 3 | 3 | 3 | 3 | 3 | 3 | 2 | 2 |
| Recirculation Valve, O/C | N/A | N/A | N/A | N/A | N/A | N/A | N/A | N/A | N/A | N/A |
| Suction Temperature | 51 | 50 | 52 | 52 | 52 | 54 | 51 | 54 | 50 | 52 |
| Discharge Temperature (F.) | 81 | 83 | 83 | 84 | 70 | 82 | 71 | 70 | 59 | 65 |
| Differential Temperature (ΔT) | 30 | 33 | 31 | 32 | 18 | 28 | 20 | 16 | 9 | 13 |

-continued

CHART 1 WATER TEMPERATURE DATA DURING BOTH NOZZLE OPEN AND DELAY (CLOSED) CONDITIONS

| | | | | | | | | | | |
|---|---|---|---|---|---|---|---|---|---|---|
| I.B. Seal Water Temperature | 56 | 58 | 57 | 57 | 58 | 57 | 56 | 58 | 53 | 55 |
| O.B. Seal Water Temperature | 88 | 91 | 93 | 91 | 87 | 89 | 82 | 78 | 67 | 74 |
| System Pressure | 1984 | 1985 | 1985 | 1985 | 1984 | 1985 | 1980 | 1981 | 2001 | 2002 |
| Suction Source Water Temperature | 50 | | | 50 | 51 | 53 | 50 | 52 | 52 | 51 |
| Flow/Shutoff | Delay | Delay | Delay | Delay | Run | Delay | Run | Run | Run | Run |

| | Test No. | | | | |
|---|---|---|---|---|---|
| | 11 | 12 | 13 | 14 | 15 |
| Descale Pumps On Line | 1–3 | 1–3 | 1–3 | 1–3 | 1–3 |
| Descale Pump No. | 1 | 1 | 1 | 1 | 1 |
| Recirculation Valve, O/C | O | O | O | O | O |
| Suction Temperature | 44 | 44 | 46 | 45 | 46 |
| Discharge Temperature | 69 | 69 | 70 | 70 | 70 |
| Differential Temperature | 25 | 25 | 24 | 25 | 24 |
| I.B. Seal Water Temperature | 52 | 51 | 53 | 52 | 54 |
| O.B. Seal Water Temperature | 74 | 76 | 77 | 75 | 76 |
| Descale Pump No. | 3 | 3 | 3 | 3 | 3 |
| Recirculation Valve, O/C | N/A | N/A | N/A | N/A | N/A |
| Suction Temperature | 41 | 44 | 43 | 42 | 43 |
| Discharge Temperature | 71 | 71 | 71 | 71 | 72 |
| Differential Temperature | 30 | 27 | 28 | 29 | 29 |
| I.B. Seal Water Temperature | 51 | 51 | 49 | 50 | 51 |
| O.B. Seal Water Temperature | 76 | 78 | 78 | 77 | 78 |
| System Pressure | 1981 | | 1980 | 1979 | 1981 |
| Flow/Shutoff | Delay | Delay | Delay | Delay | Delay |

CHART 2 (PRESSURE DATA)

| | Test No. | | | | | | |
|---|---|---|---|---|---|---|---|
| | 1 | 2 | 3 | 4 | 5 | 6 | 7 |
| Descale Pump No. | 1 | 1 | 1 | 1 | 1 | 1 | 1 |
| Pumps On Line | 1–2 | 1–2 | 1–3 | 1–3 | 1–3 | 1–3 | 1–3 |
| Recirculation Valve, O/C | O | O | O | O | O | O | O |
| ORIFICE DATA | | | | | | | |
| No. of Orifices | 2 | 2 | 2 | 2 | 2 | 2 | 2 |
| Orifice Length of each one | 4 | 4 | 4 | 4 | 4 | 4 | 4 |
| Orifice Bore (ID) (inches) | 17/64 | 17/64 | 17/64 | 17/64 | 17/64 | 17/64 | 17/64 |
| Orifice Assy In Use | MK-A | MK-A | MK-B | MK-B | MK-B | MK-B | MK-B |
| PRESSURE DATA | | | | | | | |
| P-1 (psi) | 1969 | 1970 | 1980 | 1981 | 1980 | 1987 | 1985 |
| P-2 (psi) | 1551 | 1560 | 1744 | 1745 | 1742 | 1735 | 1736 |
| Pressure Drop, P-1, P-2 (psi) | 418 | 410 | 236 | 236 | 238 | 252 | 249 |
| FLOW DATA | | | | | | | |
| Flow P-1, P-2 | 110.81 GPM | 110.81 GPM | 89.1 GPM | 89.1 GPM | 89.5 GPM | 90.1 GPM | 91.5 GPM |
| PUMP PRESSURE DATA (psi) | | | | | | | |
| Descale Pump No. | | | 1 | 1 | 1 | 1 | 1 |
| Suction (psi) | | | 96 | 98 | 97 | 96 | 97 |
| Discharge (psi) | | | 1983 | 1984 | 1983 | 1985 | 1986 |
| Orifice (psi) | | | 122 | 122 | 126 | 126 | 130 |
| Descale Pump No. | | | | | 3 | | |
| Suction (psi) | | | | | 95 | | |
| Discharge (psi) | | | | | 1900 | | |
| Orifice (psi) | | | | | 124 | | |
| System (psi) | | | 1983 | 1984 | 1983 | 1985 | 1982 |

Chart 1 above illustrates fifteen tests of the FIG. 1 descaling system. During test nos. 1–8 and 11–15, nos. 1–3 pumps were in use in the system. In test nos. 9 and 10, only two descale pumps (nos. 1–2) were in use. Of the three descale pumps (i.e. nos. 1–3) listed in Chart 1, only descale pump no. 1 was attached to a recirculation system 19. The upper half of Chart 1 describes descale pump no. 1 and its functionality as a result of its corresponding recirculation system 19, while the bottom half of Chart 1 references descale pump nos. 2 and 3 which were not attached to recirculation systems. Descale pump nos. 2–3, and their reported data, are typical of certain prior art descaling systems. The last line of data in Chart 1 indicates whether nozzles 17 were opened or closed. The term "delay" means that nozzles 17 were closed, while the term "run" means that at least one nozzle 17 was open and steel descaling was taking place.

Chart 1 clearly shows the advantage of recirculation system 19 attached to pump no. 1 in that the temperature differential (ΔT) between pump inlet or suction 11 and outlet or discharge 13 for pump no. 1 was maintained at a level less than or equal to about 25°. This was not the case for pump nos. 2 and 3 which were not attached to recirculation systems 19. For example, referring to test no. 1, the differential temperature (ΔT) between suction 11 and discharge 13 for pump no. 1 was 23° F. as a result of recirculation system 19, while the temperature differential between the inlet and outlet of pump no. 3 was an undesirably high 30° F. It is noted that it is only necessary to utilize recirculation system 19 to maintain the temperature differential across pump 9 during "delay" or closed nozzle periods. During "run" periods, when nozzles 17 are open, there is inherently a continued flow through pump 9 allowing heat to vacate the pump so that temperature differential is not a problem. Thus, when comparing the temperature differential results from pump no. 1 versus pump nos. 2 and 3 in Chart 1, one should look specifically at the tests which were performed when the system was in a "delay" state or mode.

It is also worth noting in Chart 1 that as a result of recirculation system 19, the outboard ("O.B.") seal water temperature was typically substantially lower for pump no. 1 than for pump nos. 2 and 3, especially during "delay" periods. This is noteworthy because the temperature of the water at the outboard seal affects the tolerances and stability of the seal itself. High temperatures cause thermal growth, which in turn often results in premature seal leakage or failure.

Chart 2 lists pressure data taken during seven different tests of the FIG. 1 descaling system. Each of the seven tests involved descale pump no. 1 which included recirculation system 19. In test nos. 1–2, the FIG. 2(*a*)–2(*b*) orifice system 27 was used, while in test nos. 3–7 the FIG. 3(*a*)–3(*b*) orifice system 27 was utilized. Compare the flow rate between P1 and P2 as a function of the orifice system 27 in use. It is clear that the FIG. 3(*a*)–3(*b*) orifice system 27 resulted in a lower water flow rate through the recirculation system (i.e. from about 89–92 GPM). Furthermore, it is noted that the FIG. 3(*a*)–3(*b*) orifice system 27 resulted in both a higher instantaneously available water pressure in conduit system 15 and a lower pressure drop or differential from P1 to P2 . In either event, the instantaneously available pressure in the system to nozzle 17 was between 1,400 and 2,500 psi even when the recirculation system is running, preferably from about 1,800 to 2,000 psi, and most preferably from about 1,950–2,000 psi.

FIG. 5 is a side partial cross-sectional view of valve 25 according to certain embodiments of this invention, which may be a Salem valve, Model No. 106-558-154-303, Salem, Ohio, according to certain embodiments. This valve is conventional. As shown in FIG. 5, on-off valve 25 includes housing 61, solenoid base 63, conduit connection 65, conduit connection 66, piston rod 67, coupling 68, cylinder head 69, indicator light 70, operator piston 71, cylinder 72, and plunger 73. Valve 25 operates in a conventional manner and is selectively opened and closed by pressure switch 23 as discussed above.

Once given the above-disclosure, many other features, modifications, and improvements will become apparent to the skilled artisan. Such other features, modifications, and improvements are therefore considered to be a part of this invention, the scope of which is to be determined by the following claims.

I claim:

1. A descaling system used in the manufacture of steel, the descaling system comprising:

a descaling nozzle for selectively directing a liquid under pressure toward the steel so as to descale same, said descaling nozzle adapted to be opened when it is desired to direct the liquid under pressure toward the steel for descaling same and to be closed during shutoff conditions when it is not desired to direct the liquid toward the steel;

a reservoir containing the liquid to be pumped to said descaling nozzle;

a continuously running high energy pump having an outlet connected to said descaling nozzle and an inlet connected to said reservoir, said pump for pumping the liquid from said reservoir to said descaling nozzle by way of said outlet at a flow rate of up to from about 1,500 to 4,000 gallons per minute (GPM), and at a pressure of from about 1,400 to 2,500 psi, said pump adapted to run when said descaling nozzle is both opened and closed so that while the pressure remains between about 1,400 and 2,500 psi said flow rate is subject to variation;

a recirculation system provided between said pump outlet and said reservoir for selectively recirculating liquid discharged by said pump, said recirculation system including a pressure detector and an on-off valve, said pressure detector functioning to cause said valve to open when a first predetermined threshold pressure of the liquid proximate said pump outlet is detected thereby initiating said liquid recirculating;

said pressure detector also for causing said valve to close when a second threshold pressure is detected, said first threshold pressure being greater than said second threshold pressure;

said recirculation system further including a plurality of restrictive orifices aligned in series with one another for controlling the liquid flow within said recirculation system so as to maintain the liquid pressure at from about 1,400 to 2,500 psi at said pump outlet, and to create a back pressure on said valve; and wherein said recirculation system maintains a descaling liquid temperature differential (ΔT) between said pump inlet and said pump outlet, during operation in both nozzle open and shutoff conditions, at less than or equal to about 25° F.

2. The descaling system of claim 1, wherein the liquid includes water, and wherein the descaling system further comprises means for maintaining the water pressure differential (ΔP) between said pump outlet and a point downstream of said valve but prior to said orifices, during both nozzle open and shutoff conditions, at less than about 425 psi.

3. The descaling system of claim 2, wherein said maintaining means maintains said water pressure differential (ΔP) less than about 260 psi.

4. A method of descaling steel, comprising the steps of:

providing steel which is to be descaled and a nozzle member to be selectively opened and closed for selectively directing high pressure descaling fluid toward the steel so as to descale same when the nozzle is open;

providing a descaling fluid supply and a corresponding fluid pump having an inlet and outlet;

continuously operating the pump so as to pump the fluid from said fluid supply to the nozzle at a pressure of from about 1,400 to 2,500 psi during both open-nozzle or flow, and closed-nozzle or no-flow conditions;

recirculating the descaling fluid from the pump outlet to the pump inlet during no-flow conditions so as to continuously maintain a fluid temperature differential ($\Delta T$) between the pump outlet and pump inlet less than or equal to about 25° F.;

detecting and measuring pressure of the fluid after the fluid exits the pump outlet; and opening a recirculation valve when the detected and measured pressure exceeds a predetermined first threshold value whereby allowing the fluid to be recirculated to the fluid supply.

5. The method of claim 4, wherein the first predetermined threshold value is from about 1,900 to about 2,000 psi.

6. The method of claim 4, further comprising the steps of creating a back pressure on the valve and controlling recirculating fluid flow by providing a plurality of spaced-apart restrictive orifices through which the recirculating fluid passes downstream of the valve.

7. The method of claim 4, further comprising the step of continually maintaining the temperature differential between the pump inlet and the pump outlet at from about 20°–25° F.

8. The method of claim 7, further comprising the step of pumping the fluid from the pump outlet to the nozzle at a rate of at least about 1,500 GPM.

9. A method of descaling steel, comprising the steps of:

providing steel which is to be descaled and a nozzle to be selectively opened and closed for selectively directing high pressure descaling fluid toward the steel so as to descale the steel when the nozzle is opened;

providing a descaling fluid supply and a corresponding fluid pump having an inlet and an outlet;

continuously operating the pump so as to pump the fluid from the fluid supply to the nozzle at a pressure of from about 1,400 to 2,500 psi during both open-nozzle and closed-nozzle conditions;

opening the nozzle so as to allow the descaling fluid to flow therethrough, and descaling said steel when the nozzle is opened; and closing the nozzle and recirculating the descaling fluid from the pump outlet to the pump inlet when the nozzle is closed and continuously maintaining a fluid temperature differential ($\Delta T$) between the pump outlet and the pump inlet at less than or equal to about 25° F.

* * * * *